US007696476B2

(12) United States Patent
Kim et al.

(10) Patent No.: US 7,696,476 B2
(45) Date of Patent: Apr. 13, 2010

(54) APPARATUS AND METHOD FOR IMPROVING FOURIER TRANSFORM ION CYCLOTRON RESONANCE MASS SPECTROMETER SIGNAL

(75) Inventors: Sung Hwan Kim, Seoul (KR); Myoung Choul Choi, Seoul (KR); Jong Shin Yoo, Daejeon (KR); Hyun Sik Kim, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 334 days.

(21) Appl. No.: 11/754,240

(22) Filed: May 25, 2007

(65) Prior Publication Data

US 2008/0099672 A1 May 1, 2008

(30) Foreign Application Priority Data

Oct. 31, 2006 (KR) ..... 10-2006-0106607

(51) Int. Cl.
*H01J 49/00* (2006.01)

(52) U.S. Cl. ..... 250/291; 250/281; 250/282; 250/283; 250/285; 250/287; 250/288; 250/290; 250/292; 702/31

(58) Field of Classification Search ..... 250/281–283, 250/285, 287, 288, 290–292; 702/31
See application file for complete search history.

(56) References Cited

U.S. PATENT DOCUMENTS 5,650,617 A * 7/1997 Mordehai ..... 250/290

OTHER PUBLICATIONS

Sung Hwan Kim, et al., "Modification of ICR Trapping Potential to Generate a Local Electrostatic Field Minimum to Improve Signal Resolving Power," 54$^{th}$ ASMS Conference on Mass Spectrometry and Allied Topics, May 28, 2006, Seattle, Washington.

* cited by examiner

*Primary Examiner*—Nikita Wells
*Assistant Examiner*—Meenakshi S Sahu
(74) *Attorney, Agent, or Firm*—Fenwick & West LLP

(57) ABSTRACT

Disclosed is apparatus and method for improving the signal by changing the voltage applied to an analyzing trap of a high resolving power Fourier Transform Ion Cyclotron Resonance (FT-ICR) mass spectrometer. More specifically, after the ion activation, a voltage different from that of a trap electrode is applied to an additional electrode in the center of the trap electrode, and the voltage is maintained until the end of a detection cycle. Applying the above method, the stability of the ions confined in a trap is more increased, and therefore, the detected time domain signal is being lengthened. The lengthened time domain signal results in an increase of the frequency or an improvement of the resolving power and the sensitivity of the mass-to-charge domain signal.

14 Claims, 8 Drawing Sheets

APPARATUS AND METHOD FOR IMPROVING FOURIER TRANSFORM ION CYCLOTRON RESONANCE MASS SPECTROMETER SIGNAL

CROSS-REFERENCE TO RELATED APPLICATIONS

This application claims all benefits of Korean Patent Application No. 10-2006-0106607 filed on Oct. 31, 2006 in the Korean Intellectual Property Office, the disclosures of which are incorporated herein by reference.

BACKGROUND OF THE INVENTION

1. Field of the Invention

Fourier transform ion cyclotron resonance (FT-ICR) mass spectrometry (MS) is an apparatus which analyzes the structure of molecules by estimating the mass of a molecule ion and a fragment ion. FT-ICR mass spectrometry has become the ultimate standard for high-resolution broadband mass analysis.

2. Description of the Related Art

As shown in FIG. 1, a trap used in the conventional FT-ICR mass spectrometry is generally constituted of a trap electrodes (10, 13), an independent additional electrode (11) including the center of the trap electrodes (10, 13) (so called "a sidekick electrode"), and an excitation and detection electrode (12). The independent additional electrode (11) has been used to improve the storage efficiency of the ions. Generally, after the step of ion activation, a voltage which is same as that of trap electrode (10, 13) is applied to the independent additional electrode (11) (see FIG. 2).

Resolving power in FT-ICR MS is limited by the duration of the time domain ICR signal. Therefore, there have been several approaches to improve trap design, to better understand ion motion, and to increase ion stability in an ICR ion trap. For example, a Penning trap, confines and stores ions by combination of a spatially uniform static magnetic field and a three-dimensional axial quadrupolar electrostatic field. The quadrupolar field ensures that the ion cyclotron frequency is independent of ion location in the trap.

Ions in such a trap exhibit three periodic motions (cyclotron rotation, magnetron rotation, and trapping axial oscillation). Ion stability derives from these motions. Cyclotron rotation results from the Lorentz force on an ion of mass, m, and charge, q, moving in a static magnetic field, $B_0$, and prevents ions from escaping in directions perpendicular to $B_0$. The ion cyclotron angular frequency, $\omega_c$, is given by:

$$\omega_c = \frac{qB_0}{m} \quad \text{[Equation 1]}$$

The quadrupolar trapping potential has three effects. First, it introduces a linear sinusoidal trapping axial oscillation along $B_0$, at frequency, $\omega_z$, thereby preventing ions from escaping along with the axial $B_0$-direction. Second, the cyclotron frequency is shifted downward from $\omega_c$ to $\omega_+$. Finally, there is a new magnetron rotation perpendicular to B., at frequency, $\omega_-$. $\omega_z$, $\omega_+$, and $\omega_-$ are given by:

$$\omega_z = \sqrt{\frac{2qV_{trap}\alpha}{ma^2}} \quad \text{[Equation 2]}$$

-continued $$\omega_+ = \frac{\omega_c}{2} + \sqrt{\left(\frac{\omega_c}{2}\right)^2 - \frac{\omega_z 2}{2}} \quad \text{[Equation 3]}$$

$$\omega_- = \frac{\omega_c}{2} - \sqrt{\left(\frac{\omega_c}{2}\right)^2 - \frac{\omega_z 2}{2}} \quad \text{[Equation 4]}$$

in which $\alpha$ is a characteristic measure of the trap length, and $\alpha$ depends on the trap geometry. Magnetron motion results from the radial electric field gradient generated by the electrostatic trapping potential.

In a typical closed cylindrical ICR cell, the radial electric field is directed outward toward the excitation and detection electrodes (from the inside to the outside of the trap).

The resulting outward radial force destabilizes ions, because the ion magnetron radius increases as ions lose energy by ion-neutral or ion-ion collisions, ultimately leading to radial ejection and limiting the can affect length of time that ions can be held in the trap.

It is important to note that Eqations. 2 to 4 are derived only for a perfectly quadrupolar electrostatic trapping potential. That assumption is valid only near the center of a trap and in the absence of other ions. Under those conditions, the three natural ion motions are virtually independent and ions can be confined for a long period of time without significant loss.

However, collisions with neutrals, deviation from quadrupole electrostatic trapping potential due to truncated or otherwise imperfect trap electrodes, and Coulombic charge interactions destabilize ions axially and/or radially and result in damping of the time-domain ICR signal. Under either of the described conditions, the three ion motions are no longer independent.

SUMMARY OF THE INVENTION

The present invention relates to apparatus and method for improving the signal by changing the voltage applied to an analyzing trap of a high resolving power Fourier Transform Ion Cyclotron Resonance (FT-ICR) mass spectrometer. More specifically, after the ion activation, a voltage different from that of a trap electrode is applied to an additional electrode in the center of the trap electrode, and the voltage is maintained until the end of a detection cycle.

Applying the above method, the stability of the ions confined in a trap is more increased, and therefore, the detected time domain signal is being lengthened. The lengthened time domain signal results in an increase of the frequency or an improvement of the resolving power and the sensitivity of the mass-to-charge domain signal.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF EMBODIMENTS

Fourier transform ion cyclotron resonance (FT-ICR) mass spectrometry is an analyzing apparatus which has a high resolving power. It is important to detect the ions while having them remained in an analyzing trap as long as possible in order to obtain a high resolving power spectrum.

An object of the present invention is to increase the stability of the ions confined in a trap by optimizing a voltage applied to the trap in accordance with each experimental step. The motion of stabilized ions ultimately lengthens the detected time domain signal, and results in an increase of the frequency or an improvement of the resolving power and the sensitivity of mass-to-charge domain signal.

In order to achieve the above mentioned object, the present invention relates to a mass spectrometer, more specifically, a method and apparatus for improving the analyzing capability of Fourier Transform Ion Cyclotron Resonance (FT-ICR) mass spectrometer.

Specifically describing, it is a method for improving the signal by transforming the trapping potential applied to an analyzing trap of a high resolving power Fourier Transform Ion Cyclotron Resonance (FT-ICR) mass spectrometer according to the detection steps. In other words, it is a method for applying a voltage different from that of a trap electrode to an additional electrode in the center of the trap electrode after the ion activation, and maintaining the voltage until the end of a detection cycle.

Considering the specific constitution of the present invention which is a method for improving Fourier Transform Ion Cyclotron Resonance (FT-ICR) mass spectrometer using an ICR trap, the ICR trap comprises at least two trap electrodes separately disposed in the front and in the back; at least one additional electrode, which is electrically independent and is a portion of each of said trap electrodes; and an excitation and detection electrode disposed between said front and back trap electrode to from an ICR trap. According to one embodiment of the present invention, the number of the additional electrode is two, each of which is electrically independent and is a portion of each of said trap electrodes.

Further, an ICR detection cycle comprises a step of transferring said ion to said ICR trap; a step of activating said ion; and a step of detecting said ion, wherein applying a voltage which is different from that of said trap electrode to said additional electrode, and maintaining said voltage until the end of a detection cycle.

Also, the voltage applied to the additional electrode (or electrodes) may be smaller than the voltage at the trap electrodes in the positive ion detection, and the voltage applied to the additional electrode (or electrodes) may be bigger than the voltage at the trap electrodes in the negative ion detection.

Figure 1:
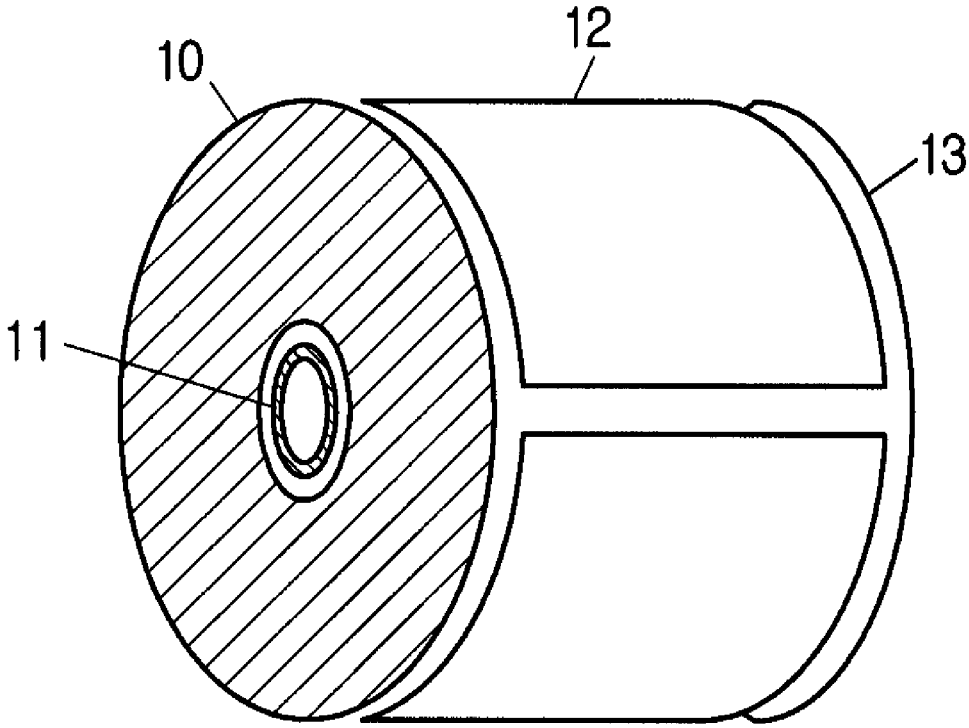
FIG. 1 is a schematic diagram of the structure of a trap in which an electrically independent additional electrode is set up in the center of a trap electrode.

This method according to the present invention is applicable to various forms of the trap other than the general trap form described in FIG. 1. In other words, the ICR trap of above mentioned constitution can have various forms including a cylinder form and a cube form.

Also, the additional electrode constituting a portion of the trap electrode in the ICR trap comprises a hole of the ion introduction part in the center of the ICR trap, and has the form of a cylinder form or a cube form which is similar to the form of the ICR trap, with the size same as the ICR trap or smaller than the ICR trap.

A voltage different from that of the trap electrode is applied to the additional electrode, and both direct current potential and a alternating current potential are available.

Hereinafter, a preferred embodiment of the present invention will be described with reference to the accompanying drawings. In the following description of the present invention, a detailed description of known functions and configurations incorporated herein will be omitted when it may make the subject matter of the present invention rather unclear.

Here, we demonstrate experimentally that a simple modification of the trapping potential can significantly improve mass resolving power in FT-ICR MS. The modification is achieved simply by applying a voltage which is different from a trapping voltage to an additional electrode in the center of the trap electrode after ion excitation.

Figure 2:
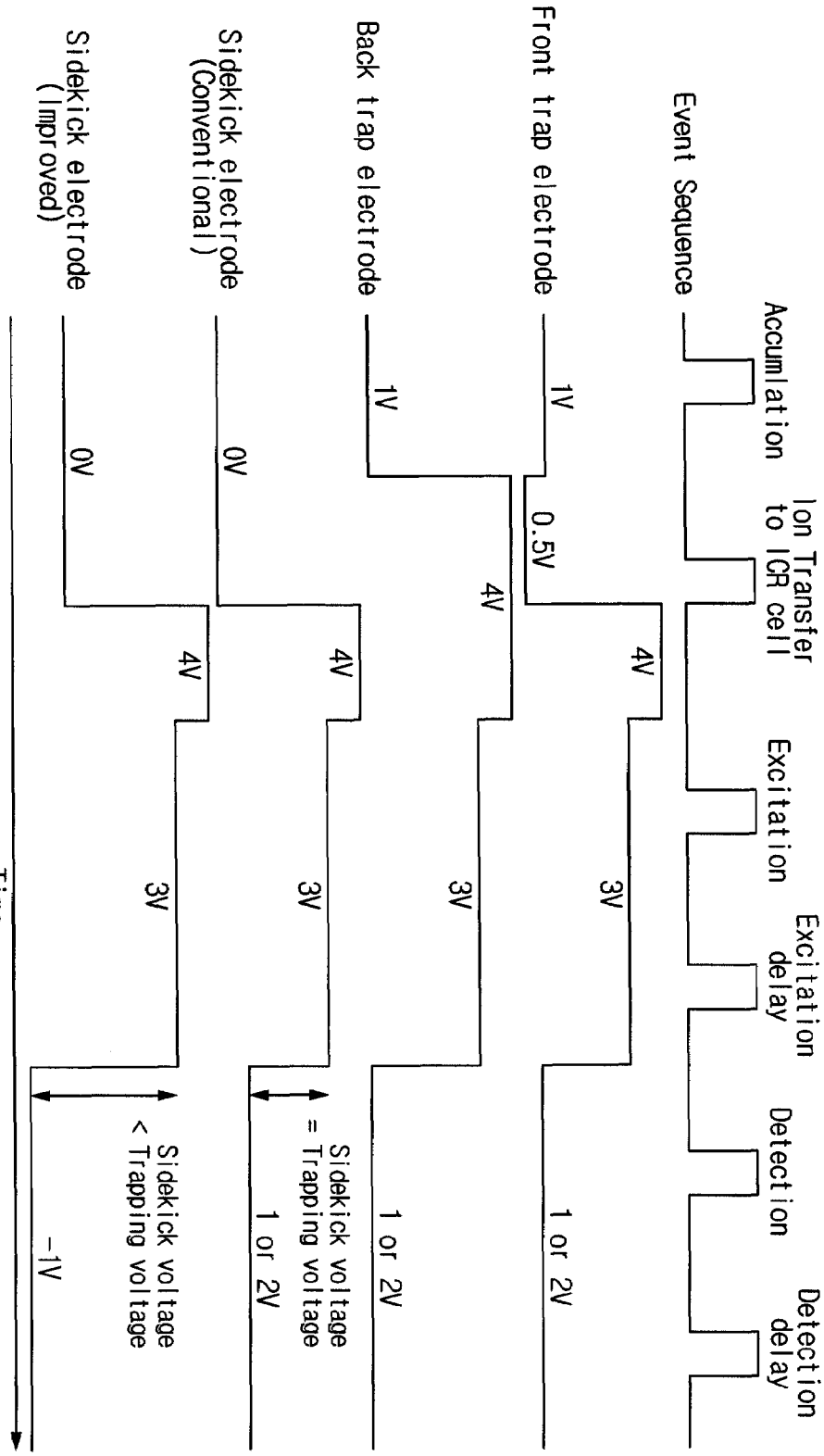
FIG. 2 shows each step of an experiment for applying a voltage to a trap electrode and an independent additional electrode according to one embodiment of the present invention.

A series of experimental steps are described in FIG. 2. Briefly, ions are accumulated in a hexapole collision cell for 0.1~1 second according to analyte concentration. Ions are transported to the ICR trap during a transfer period of 1.6~2.0 millisecond, and captured in the ICR trap by lowering the voltage of the front trap electrode below voltage of the back trap electrode and raising the voltage of the back trap electrode.

In conventional operation, independent additional electrodes are held at the same voltage as the trap electrodes. Shortly (2.0 ms) after ions enter the ICR trap, the trapping voltage is raised to 4 V to hold ions in the ICR cell. Ions were excited to 30%~50% of the cell diameter by broadband frequency-sweep (chirp) dipolar excitation (25~539 kHz at a sweep rate of 100~250 Hz/μs).

Direct mode image current detection was performed to yield time-domain data. Time-domain data sets (512k~8M data points) were co-added to enhance signal to noise ratio, and then, followed by fast Fourier transformation. Frequency was converted to mass-to-charge ratio by the quadrupolar electric trapping potential approximation.

Positive vs. Negative Sidekick Electrode Voltage During ICR Detection

Sidekick electrodes improve ion trapping efficiency by deflecting ions away from the central axis, so that incident ions cannot pass back through the front end cap aperture after reflection from the back end cap electrode.

However, the deflected ions acquire a significant magnetron radius, and are more rapidly lost from the cell due to magnetron radial expansion. We therefore typically employ gated trapping, whereby the sidekick electrode is held at the same voltage as the front trap electrode.

As shown in FIG. 2, we found that the time-domain ICR signal duration could be significantly extended by switching the sidekick electrode potential to a negative voltage after excitation according to one embodiment of the present invention.

Figure 3A:
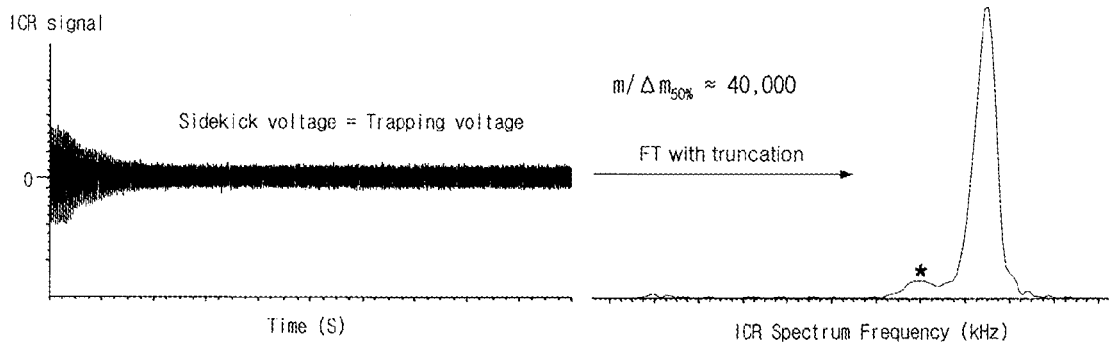
FIG. 3A is a diagram describing an ICR signal in a time domain and a frequency domain when the voltage of an independent additional electrode is the same as that of a trap electrode according to one embodiment of the present invention.
Figure 3B:
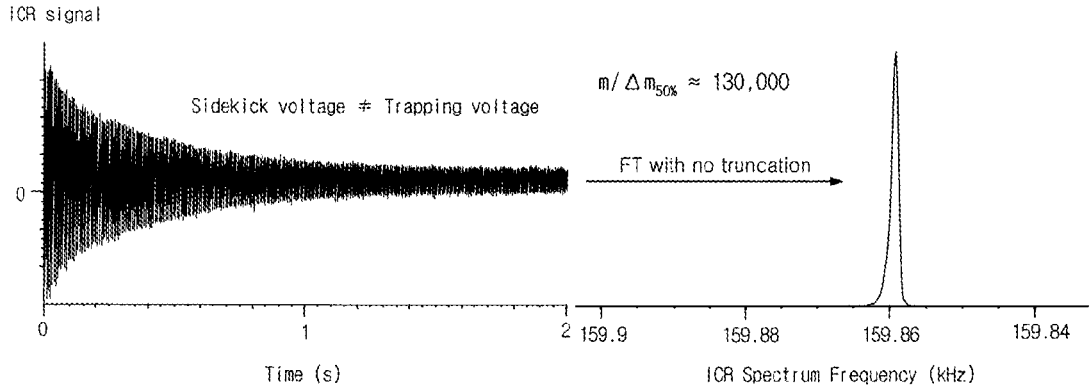
FIG. 3B is a diagram describing an ICR signal in a time domain and a frequency domain when the voltage of an independent additional electrode is smaller than that of a trap electrode according to one embodiment of the present invention.

Time-domain ICR signals obtained at positive and negative sidekick voltage values according to one embodiment of the present invention are displayed in FIG. 3A and FIG. 3B. All other experimental conditions were identical. The detected image current scale is the same in both plots.

As shown in FIG. 3A, for sidekick voltage during detection equal to the trapping voltage, the time-domain ICR signal is relatively low in amplitude and lasted only for a couple of hundred milliseconds.

However, as shown in FIG. 3B, differentiation between the trapping voltage and the sidekick voltage during detection increased both the amplitude and duration (more than 2 seconds) of the time-domain ICR signal.

To display the difference of the resolving power while maintaining the similar signal to noise ratio, the time-domain signal obtained with the same side kick voltage as the trapping voltage was truncated by half before Fourier transformation.

Also, mass spectral resolving power, $m/\Delta m_{50\%}$ (in which $\Delta m_{50\%}$ is the peak full width at half-maximum peak height) improved more than three-fold from 40,000 to 130,000. Application of a negative voltage (up to −2 V, not shown) did not reduce ion trapping efficiency.

Figure 4A:
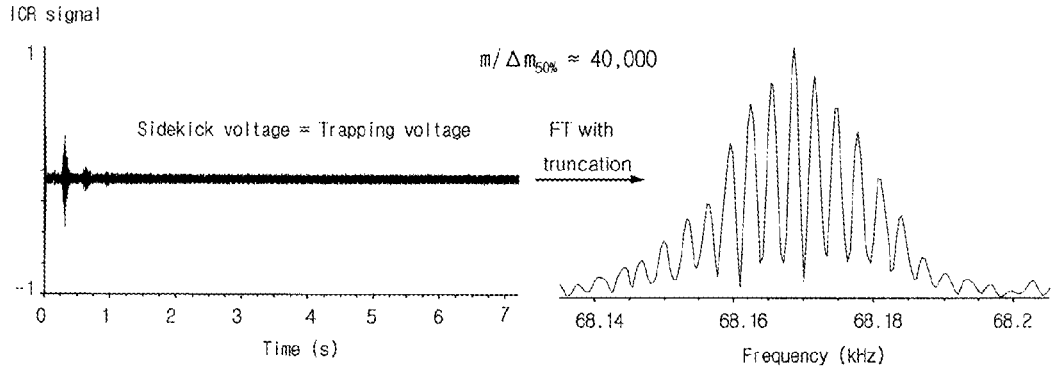
FIG. 4A is a diagram describing an ICR signal in a time domain and a frequency domain when the voltage of an independent additional electrode is the same as that of a trap electrode according to one embodiment of the present invention.
Figure 4B:
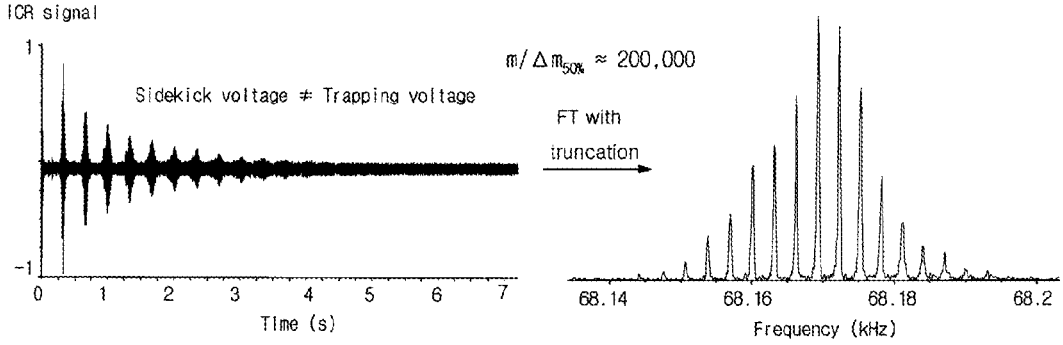
FIG. 4B shows increasing the duration of a time domain ICR signal in FIG. 4A.

FIG. 4A and FIG. 4B show that the salutary effects of the addition of a sidekick electrode also extend to the analysis of human growth hormone protein (monoisotopic neutral mass=22,115.072 Da) with increased time-domain signal duration from 1.5 to 7 seconds, and correspondingly enhanced FT-ICR mass spectral signal-to-noise ratio and five-fold improvement in resolving power according to one embodiment of the present invention.

SIMION Simulations of Electrostatic Potential

Figure 5A:
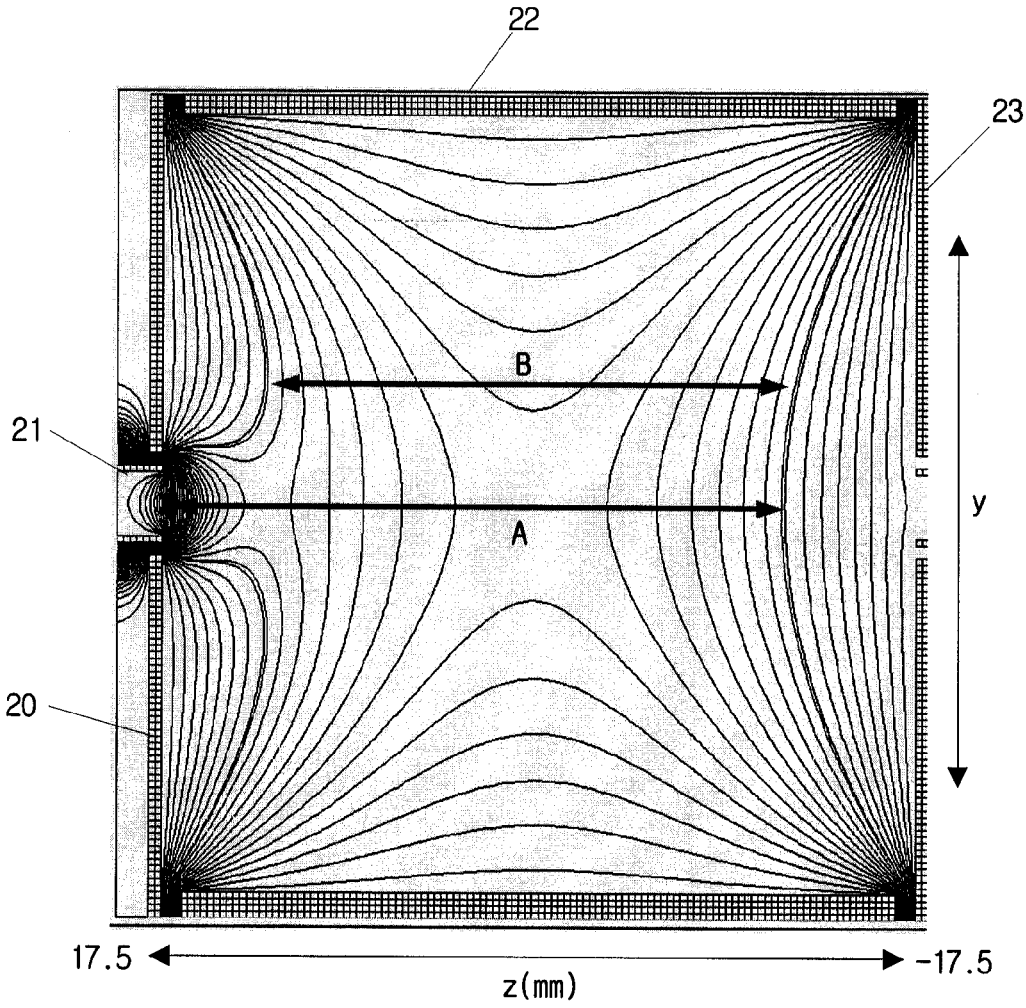
FIG. 5A is a diagram of a two dimensional equipotential line which is theologically estimated while connecting a direct current potential to an ICR trap.
Figure 5B:
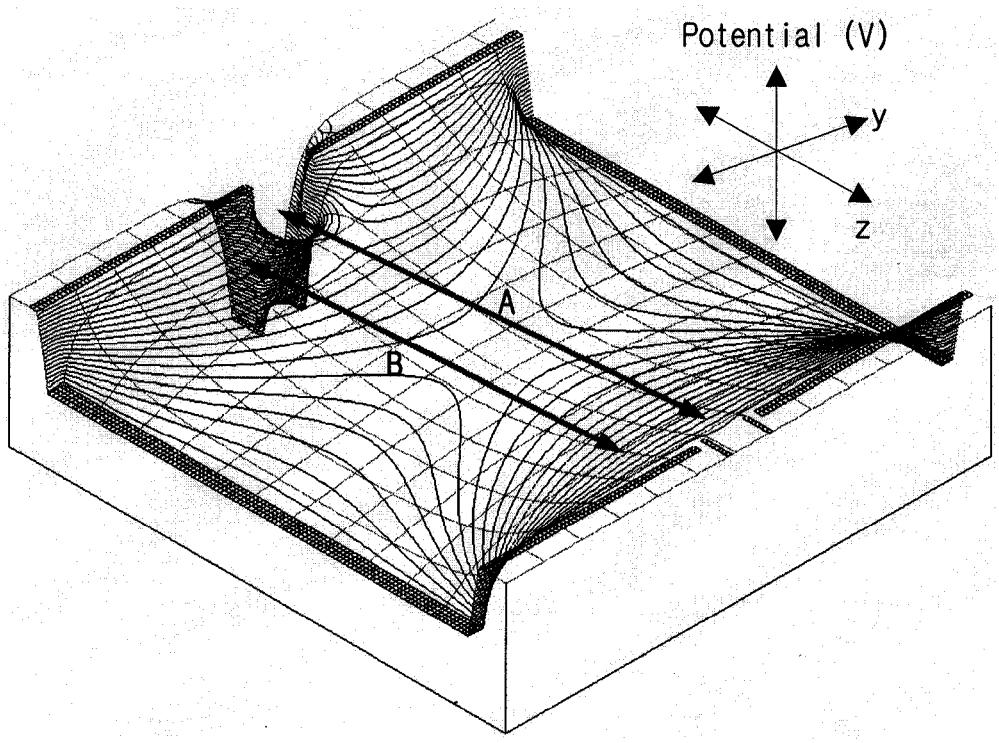
FIG. 5B is a diagram of a three dimensional equipotential line which is theologically estimated while connecting a direct current potential to an ICR trap.
Figure 6A:
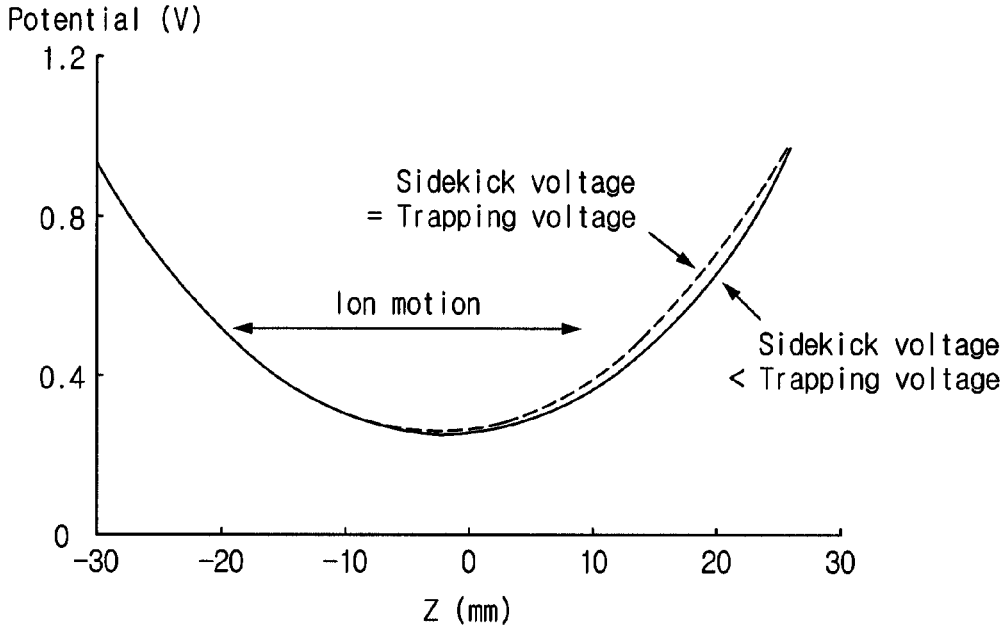
FIG. 6A is a diagram showing the potential of the inner ICR trap with respect to each potential of an independent additional electrode according to one embodiment of the present invention.
Figure 6B:
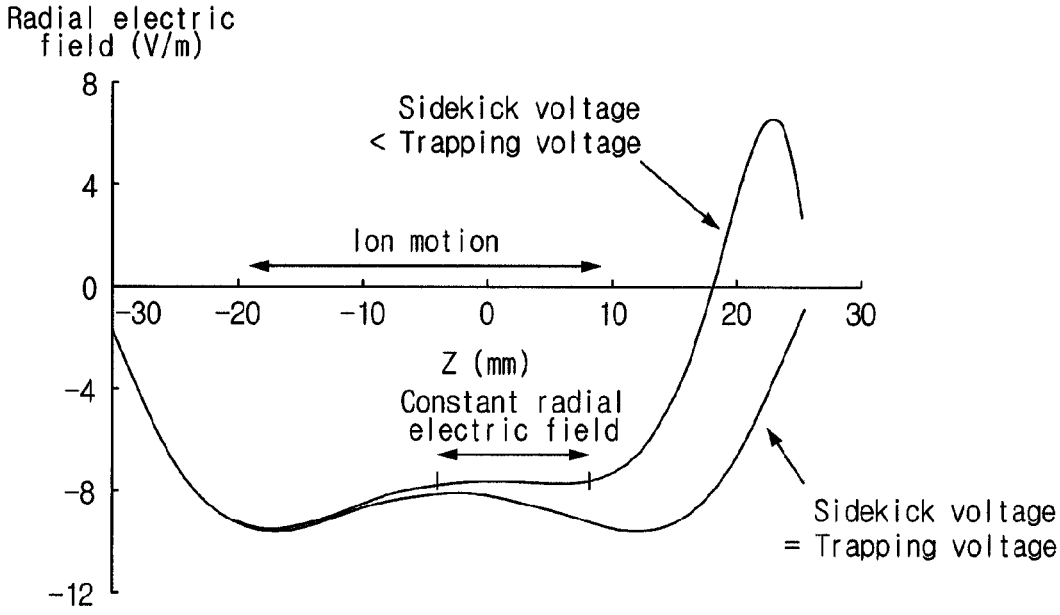
FIG. 6B is a diagram showing the radial electric field of the inner ICR trap with respect to each potential of an independent additional electrode according to one embodiment of the present invention.

The electrostatic potential and radial electric field at a typical post-excitation ion cyclotron radius (33% of the trap radius, path B in FIG. 5A and FIG. 5B) as a function of axial position, z, are shown in FIG. 6A and FIG. 6B.

As shown in FIG. 6A, applying a negative voltage to the sidekick electrodes changes the electrostatic potential only slightly due to the radial distance from the sidekick electrode and its smaller physical diameter (6 mm) compared to that of the front trap electrode (60 mm).

As shown in FIG. 6B, the change in radial potential gradient due to +1V or −1V sidekick voltage is more significant. In a perfectly quadrupolar electrostatic trapping potential, the radial electric field increases linearly with increasing r but is independent of z.

In the actual trap of FIG. 5A and FIG. 5B, application of +1V to the sidekick electrodes generates a double-well radial electric field as a function of z, whereas application of −1V to the sidekick electrodes raises the bottom of one of those wells by about 25%, so that the radial electric field becomes essentially independent of z near the trap midplane and at 33% of the trap radius (see FIG. 6B).

In that respect, the negative sidekick electrode voltage effectively flatten the axial potential and thus result in flat radial electric field as a function of z.

In other words, ions subjected to negative sidekick electrode voltage encounter an electrostatic trapping potential that closely approximates quadrupolar, at 33% of cell radius and near the trap midplane.

Moreover, the sideband at a frequency of $\omega_+ \sim \omega_-$ indicates that magnetron and cyclotron are non-linearly coupled, leading to energy exchange between ion oscillation modes. For example, increase in magnetron rotation radius can lead to radial loss of ions from the ICR trap.

Application of negative sidekick voltage reduces non-linearity and thus may contribute to increased ion stability in the ICR cell.

Another consequence of the negative sidekick voltage is the generation of an inverted potential gradient well near the front trap electrode as shown in FIG. 6B. In that region of the trap, ions are subjected to an inward-directed force rather than the usual radially outward-directed force in a perfectly quadrupolar potential, thereby potentially stabilizing ions against radial magnetron loss.

In summary, applying a negative voltage to the sidekick electrodes offers yet another approach to tailoring the electrostatic trap potential for enhanced signal-to-noise ratio and/or mass resolving power.

As described above, we have shown that applying a voltage different from that of the trap electrode to the sidekick electrodes during ICR detection can significantly improve FT-ICR mass spectral signal-to-noise ratio and/or mass resolving power.

According to such constitution of the present invention, the detected time-domain signal is to be lengthened since the ions in the trap are being more stabilized. The lengthened time-domain signal results in an increase of the frequency or an improvement of the resolving power and the sensitivity of the mass-to-charge domain signal.

In the current configuration of the ICR trap, modification can be done at only one end of the trap. However, it is reasonable to expect that symmetric trap potential modification on both ends of the trap could be even more beneficial. Moreover, similar trap potential modification could be applied to other ICR ion trap geometries.

While the invention has been shown and described with reference to certain preferred embodiments thereof, it will be understood by those skilled in the art that various changes in form and details may be made thereto without departing from the spirit and scope of the invention as defined by the appended claims.

What is claimed is:

1. A method for improving a Fourier Transform Ion Cyclotron Resonance (FT-ICR) mass spectrometer using an ICR trap comprising:

at least two trap electrodes separately disposed in the front and in the back of the ICR trap of the FT-ICR mass spectrometer;

at least one additional electrode, which is electrically independent and is a portion of one of said trap electrodes; and an excitation and detection electrode disposed between said front and back trap electrodes to form said ICR trap, the method including an ICR detection cycle comprising:

transferring ions to said ICR trap;

activating said ions; and detecting said ions while applying a voltage to said at least one additional electrode, wherein the voltage applied to said at least one additional electrode while said ions are detected is different from that of said trap electrode.

2. The method according to claim 1, wherein the number of said additional electrodes is two, each of which is electrically independent and is a portion of each of said trap electrodes.

3. The method according to claim 1, wherein said voltage applied to said at least one additional electrode is maintained until the end of a detection cycle.

4. The method according to claim 1, wherein said voltage at said at least one additional electrode is smaller than the voltage at said trap electrodes in the positive ion detection.

5. The method according to claim 1, wherein said voltage at said at least one additional electrode is bigger than the voltage at said trap electrodes in the negative ion detection.

6. The method according to claim 3, wherein the form of said ICR trap is one of a cylinder form and a cube form.

7. The method according to claim 3, wherein said additional electrode comprises an ion introduction part in the center of said ICR trap, and is divided into at least one portion, wherein the form of said additional electrode is one of a round form, a cylinder form and a cube form.

8. The method according to claim 3, wherein a direct current potential or an alternating current potential is applied to said additional electrode.

9. The method according to claim 4, wherein the form of said ICR trap is one of a cylinder form and a cube form.

10. The method according to claim 4, wherein said additional electrode comprises an ion introduction part in the center of said ICR trap, and is divided into at least one portion, wherein the form of said additional electrode is one of a round form, a cylinder form and a cube form.

11. The method according to claim 4, wherein a direct current potential or an alternating current potential is applied to said additional electrode.

12. The method according to claim 5, wherein the form of said ICR trap is one of a cylinder form and a cube form.

13. The method according to claim 5, wherein said additional electrode comprises an ion introduction part in the center of said ICR trap, and is divided into at least one portion, wherein the form of said additional electrode is one of a round form, a cylinder form and a cube form.

14. The method according to claim 5, wherein a direct current potential or an alternating current potential is applied to said additional electrode.

* * * * *